US007086311B2

(12) United States Patent
Liaw

(10) Patent No.: US 7,086,311 B2
(45) Date of Patent: Aug. 8, 2006

(54) PNEUMATIC RATCHET WRENCH

(75) Inventor: Jian-Shiou Liaw, Taiping (TW)

(73) Assignee: Rea Lee Industrial Co., Ltd., Taighung Hsien (TW)

( * ) Notice: Subject to any disclaimer, the term of this patent is extended or adjusted under 35 U.S.C. 154(b) by 0 days.

(21) Appl. No.: 10/940,628

(22) Filed: Sep. 15, 2004

(65) Prior Publication Data

US 2006/0053980 A1 Mar. 16, 2006

(51) Int. Cl.
*B25B 13/46* (2006.01)

(52) U.S. Cl. ..... 81/57.39; 81/57.13

(58) Field of Classification Search ..... 81/57.11, 81/57.13, 57.29, 57.39
See application file for complete search history.

(56) References Cited

U.S. PATENT DOCUMENTS 5,450,773 A * 9/1995 Darrah et al. ..... 81/57.39
6,789,448 B1 * 9/2004 Ono et al. ..... 81/57.39

* cited by examiner

*Primary Examiner*—David B. Thomas
(74) *Attorney, Agent, or Firm*—Troxell Law Office, PLLC

(57) ABSTRACT

A pneumatic ratchet wrench has a body, an air input valve, a switch, a propeller, an eccentric spindle, a lever, a sleeve, a nut and a head. The body has a cavity, a front end and a rear end. The air input valve, the switch, the propeller, the eccentric spindle, the sleeve, the nut and the head are mounted inside the body in sequence from the rear end to the front end. The pneumatic ratchet wrench has few elements so that it provides an easy assembly for operators. Also, the pneumatic ratchet wrench has a small volume and can be used in a small space.

3 Claims, 4 Drawing Sheets

PNEUMATIC RATCHET WRENCH

BACKGROUND OF THE INVENTION

1. Field of Invention

The present invention relates to a pneumatic ratchet wrench, more particularly to a pneumatic ratchet wrench that has a small volume and can be assembled easily.

2. Description of the Related Art

With reference to FIGS. 3 and 4, a conventional pneumatic ratchet wrench has a body (30), an air input valve (31), a switch (32), a propeller (33), a gear assembly (34), an eccentric spindle (35), a lever (36), a sleeve (37), a nut (38), a washer (402) and a head (40).

The body (30) has a front end, a rear end, a top, a bottom, a through hole (303), a longitudinal through hole (304), an inner surface, a longitudinal cavity (301) and a threaded end (302). The longitudinal cavity (301) is defined in the body (30). The threaded end (302) is defined in the inner surface near the front end. The through hole (303) is defined in the body (30) from the top to the bottom. The longitudinal through hole (304) is defined in the body (30) and communicated with the through hole (303).

The air input valve (31) is mounted inside the rear end of the body (30) and has a rear end, a front end, a joint (311) and an airway (312). The joint (311) is defined at the rear end of the air input valve (31). The airway (312) is longitudinally defined through the air input valve (31) and communicated with the through hole (303) in the body (30).

The switch (32) is mounted in the through hole (303) in the body (30) and has a button, a valve (322) and a spring (323). The button is mounted inside the through hole (303) in the body (30) at the top. The spring (323) has two ends, and one end of the spring (323) abuts the button and the other end of the spring (323) abuts the valve (322). The valve (322) has an extended end extending out the bottom of the body (30).

The propeller (33) is mounted in the longitudinal cavity (301) in the body (30) and communicated with the longitudinal through hole (304) in the body (30). The propeller (33) has multiple vanes (331), a spindle (332) and a gear-like part (333). The spindle (332) has a front end, a middle end and an outer surface. The vanes (331) are respectively mounted on the outer surface of the spindle (332) at the middle end, and the gear-like part (333) is defined on the outer surface of the spindle (332) at the front end.

The gear assembly (34) is mounted on the front end of the propeller (33) and has a cap (341) and three gears (342). The gears (342) are respectively engaged with the gear-like part (333) of the propeller (33). The cap (341) is mounted on the gears (342) and has a gear-like central hole.

The eccentric spindle (35) is mounted on the cap (341) of the gear assembly (34) and has a center, a front end, a rear end, an outer surface, a rod (351) and a gear-like part. The rod (351) is mounted on the front end of the eccentric spindle (35) away from the center. The gear-like part is defined in the outer surface of the eccentric spindle (35) at the rear end and engaged with the gear-like central hole in the cap (341).

The lever (36) is pivotally mounted on the bottom of the body (30) and abuts the extended end of the valve (322).

The sleeve (37) is partially mounted inside the longitudinal cavity (301) in the body (30) and has a teeth-like inner surface and a threaded outer surface. The threaded outer surface of the sleeve (37) is screwed in the threaded end (302) of the body (30) and the teeth-like inner surface of the sleeve (37) is engaged with gear assembly (34). The nut (38) is screwed on the threaded outer surface of the sleeve (37).

The head (40) is mounted on the nut (38) and has a U-shaped bracket (401) g and a ratchet head (41). The U-shaped bracket (401) has a front end, a rear end and two mounting holes. The ratchet head (41) is received inside the U-shaped bracket (401) and has a fan-shaped action part (411) and a post (416). The post (416) has a top, a bottom, a side surface (not numbered), a set of teeth (418), a rod (417) and a lock washer (42). The rod (417) is formed on the bottom of the post (416). The set of teeth (418) is defined in the side surface of the post (416). The lock washer (42) is mounted in the U-shaped bracket (401) on the fan-shaped action part (411). The fan-shaped action part (411) has a front end, a rear end, a central hole, a ratchet inner surface (412), a recess (413) and a connector (414). The ratchet inner surface (412) is mounted inside the central hole of the fan-shaped action part (411) and engaged with the set of teeth (418) in the post (416) allowing one direction movement. The recess (413) is defined in the rear end of the fan-shaped action part (411). The connector (414) is received inside the recess (413) and has a hole (415). The hole (415) is defined in the connector (414) and the rod (351) is mounted through the hole (415) in the connector (414).

When the conventional pneumatic ratchet wrench is used, a tool head is mounted on the rod (417), and the lever (36) is pressed. A provided air passes through the air input valve (31) from the joint (311), and the air passes through the airway (312), the through hole (303) and the longitudinal through hole (304) to drive the vanes (331) on the propeller (33). The gear assembly (34) reduces the speed of the driven propeller (33) and the eccentric spindle (35) will also be driven by the propeller (33). Because the connector (414) is mounted on the eccentric spindle (35) and connected to the ratchet head (411), the ratchet head (411) will swing in the U-shaped bracket (401). The swinging ratchet head (411) drives the post (416) by the set of teeth (418) engaged with the ratchet inner surface (412) of the ratchet head (411) and the tool head mounted on the rod (417) will be driven.

However, the disadvantages of the conventional pneumatic ratchet wrench are described as follow.

1. The volume of the conventional pneumatic ratchet wrench is too large, and so a person cannot use the pneumatic ratchet wrench in a small space easily.

2. The components of the conventional pneumatic ratchet wrench are many and complex, and a person cannot assemble or repair the pneumatic ratchet wrench easily.

The pneumatic ratchet wrench in accordance with the present invention obviates or mitigates the aforementioned problems.

SUMMARY OF THF INVENTION

The primary objective of the present invention is to provide a pneumatic ratchet wrench that has a body, an air input valve, a switch, a propeller, an eccentric spindle, a lever, a sleeve, a nut and a head. The body has a cavity, a front end and a rear end. The air input valve, the switch, the propeller, the eccentric spindle, the sleeve, the nut and the head are mounted inside the body in sequence from the rear end to the front end.

The pneumatic ratchet wrench has few elements and so is easy to assemble. Also, the pneumatic ratchet wrench has a small volume and can be used in a small space.

Other objectives, advantages and novel features of the invention will become more apparent from the following detailed description when taken in conjunction with the accompanying drawings.

DETAILED DESCRIPTION OF THE INVENTION

Figure 1:
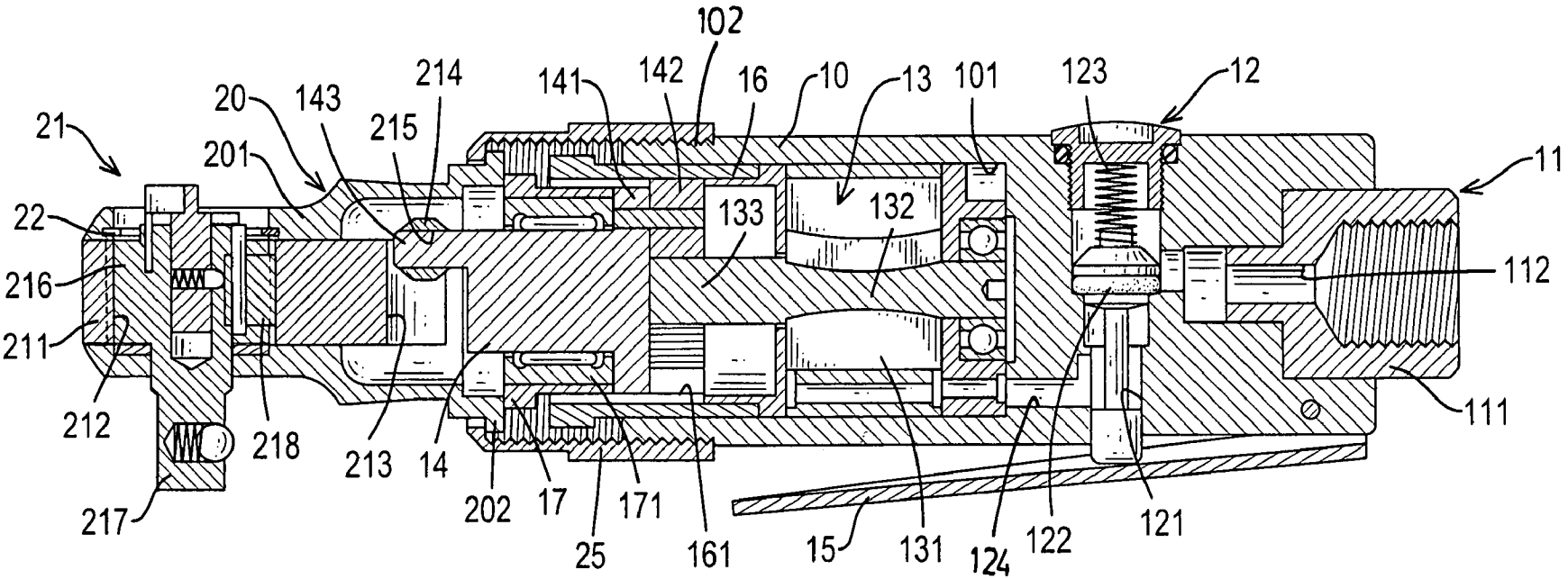
FIG. 1 is a side plan view of a pneumatic ratchet wrench in accordance with the present invention.
Figure 2:
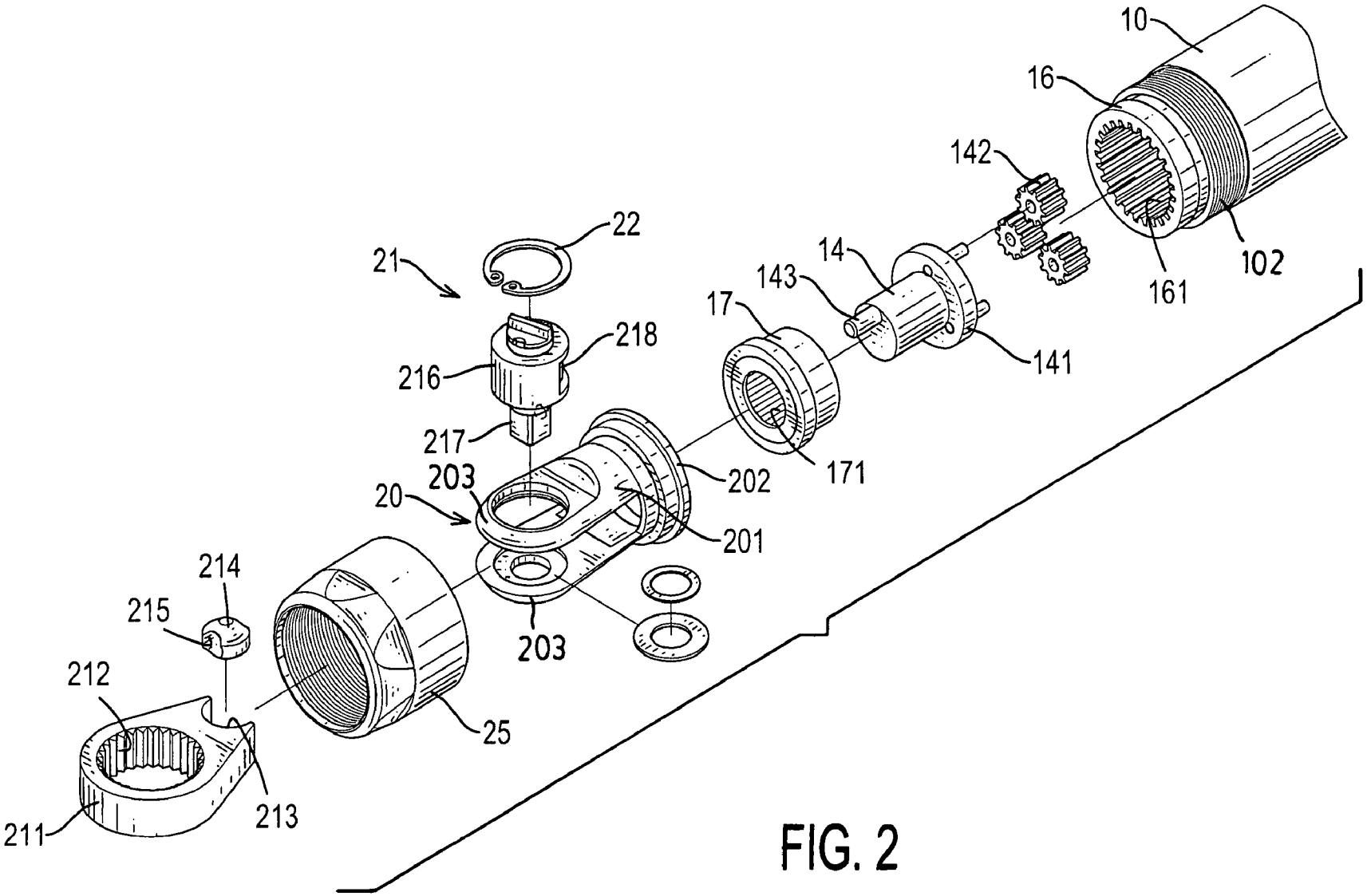
FIG. 2 is a partial exploded perspective view of the pneumatic ratchet wrench in FIG. 1.
Figure 3:
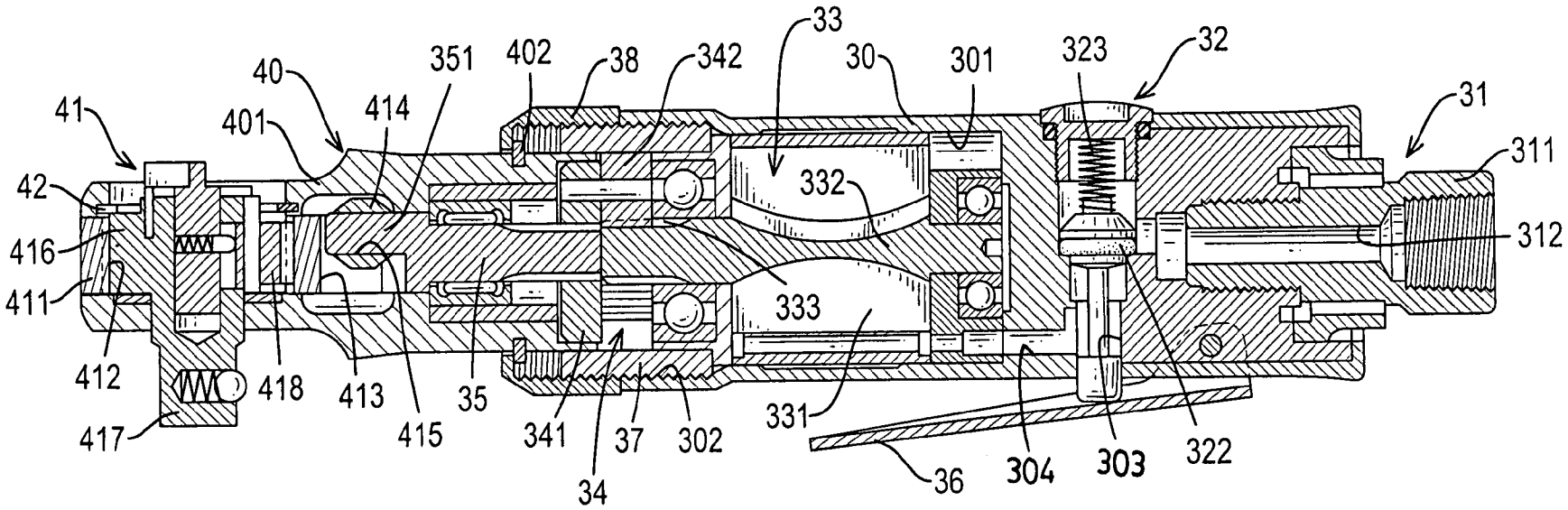
FIG. 3 PRIOR ART
FIG. 3 is a side plan view of a conventional pneumatic ratchet wrench in the prior art.
Figure 4:
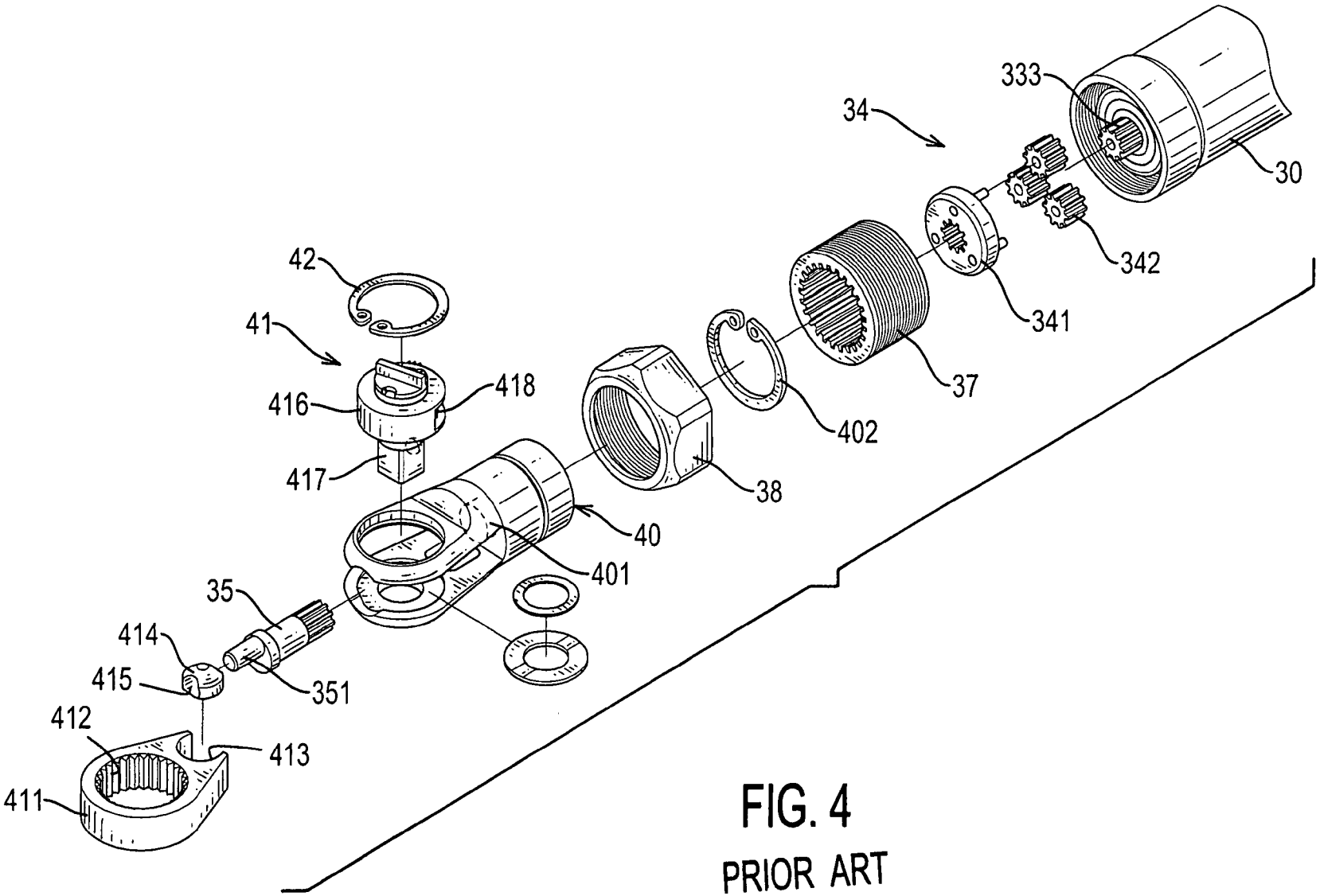
FIG. 4 PRIOR ART
FIG. 4 is a partial exploded perspective view of the pneumatic ratchet wrench in FIG. 3

With reference to FIGS. 1 and 2, a pneumatic ratchet wrench in accordance with the present invention has a body (10), an air input valve (11), a switch (12), a propeller (13), an eccentric spindle (14), a lever (15), a sleeve (16), an optional spindle sleeve (17), a nut (25) and a head (20).

The body (10) has a front end, a rear end, a top, a bottom, a through hole (121), a longitudinal through hole (124), an outer surface, a longitudinal cavity (101) and a threaded end (102). The longitudinal cavity (101) is defined in the body (10). The threaded end (102) is defined in the outer surface near the front end. The through hole (121) is defined in the body (10) from the top to the bottom. The longitudinal through hole (124) is defined in the body (10) and communicated with the through hole (121).

The air input valve (11) is mounted inside the rear end of the body (10) and has a rear end, a front end, a joint (111) and an airway (112). The joint (111) is defined at the rear end of the air input valve (11). The airway (112) is longitudinally defined through the air input valve (11) and communicated with the through hole (121) in the body (10).

The switch (12) is mounted in the through hole (121) in the body (10) and has a button, a valve (122) and a spring (123). The button is mounted inside the through hole (121) in the body (10) at the top. The spring (123) has two ends, and one end of the spring (123) abuts the button and the other end of the spring (123) abuts the valve (122). The valve (122) has an extended end extending out the bottom of the body (10).

The propeller (13) is mounted in the longitudinal cavity (101) in the body (10) and communicated with the longitudinal through hole (124) in the body (10). The propeller (13) has multiple vanes (131), a spindle (132) and a gear-like part (133). The spindle (132) has a front end, a middle end and an outer surface. The vanes (131) are respectively mounted on the outer surface of the spindle (132) at the middle end, and the gear-like part (133) is defined on the outer surface of the spindle (132) at the front end.

The eccentric spindle (14) is mounted on the front end of the propeller (13) and has a center, a front end, a rear end, an outer surface, a lip (141), a gear assembly (142), and a rod (143). The lip (141) is formed on the outer surface of the eccentric spindle (14) at rear end. The gear assembly (142) has multiple gears and the gears are respectively engaged with the gear-like part (133) of the propeller (13) at the rear end of the eccentric spindle (14). The rod (143) is extended out at the front end of the eccentric spindle (14) away from the center. In a preferable embodiment, the gear assembly (142) has three gears engaged with the gear-like part (133) of the propeller (13).

The lever (15) is pivotally mounted on the bottom of the body (10) and abuts the extended end of the valve (122).

The sleeve (16) is mounted inside the longitudinal cavity (101) in the body (10) and has an inner surface and a teeth-like part (161). The teeth-like part (161) is defined in the inner surface of the sleeve (16) and engaged with the gear assembly (142) of the eccentric spindle (14).

The optional spindle sleeve (17) is partially mounted inside the sleeve (16) and holds the eccentric spindle (15) in place. The spindle sleeve (17) has a front end, a rear end, a cavity, an outer surface, an inner surface, a teeth-like inner surface (171) and an annular lip. The annular lip is formed on the outer surface of the spindle sleeve (17) at the front end. The teeth-like inner surface (171) is defined in the inner surface of the spindle sleeve (17).

The nut (25) is screwed at the threaded end (102) of the body (10) and has a threaded inner surface.

The head (20) is mounted on the nut (25) and has a U-shaped bracket (201) and a ratchet head (21). The U-shaped bracket (201) has a front end, a rear end, an outer surface, two pieces (203), two mounting holes and an annular lip (202). The mounting holes are respectively defined in the two pieces (203) of the U-shaped bracket (201). The annular lip (202) are formed on the outer surface of the U-shaped bracket (201) at the rear end. The ratchet head (21) is received inside the mounting holes in the U-shaped bracket (201) and has a fan-shaped action part (211) and a post (216). The post (216) is mounted through the U-shaped bracket (201) and has a top, a bottom, a side surface, a set of teeth (218), a rod (217) and a lock washer (22). The rod (217) is formed on the bottom of the post (216). The tooth (218) is defined in the side surface of the post (216). The lock washer (22) is mounted in the U-shaped bracket (201) on the fan-shaped action part (211). The fan-shaped action part (211) is mounted in the U-shaped bracket (201) and has a front end, a rear end, a central hole, a ratchet inner surface (212), a recess (213) and a connector (214). The ratchet inner surface (212) is mounted inside the central hole of the fan-shaped action part (211) and engaged with the teeth (218) in the post (216) allowing the set of teeth (218) to move in only one direction. The recess (213) is defined in the rear end of the fan-shaped action part (211). The connector (214) is received inside the recess (213) and has a hole (215) that is defined in the connector (214) and the rod (143) is mounted through the hole (215) in the connector (214).

When the pneumatic ratchet wrench is used, a tool head is mounted on the rod (217) and the lever (15) is pressed. Air is input from the air valve (11). A provided air passes through the air input valve (11) from the joint (111), and the air passes through the airway (112), the through hole (121) and the longitudinal through hole (124) to drive the vanes (131) on the propeller (13). The gear assembly (142) reduces the speed of the driven propeller (13) and the eccentric spindle (14) will also be driven by the propeller (13). Because the connector (214) is mounted on the eccentric spindle (14) and connected to the ratchet head (211), the ratchet head (211) will swing in the U-shaped bracket (201). The swinging ratchet head (211) drives the post (216) by the set of teeth (218) engaged with the ratchet inner surface (212) of the ratchet head (211) and the tool head mounted on the rod (217) will be driven.

The advantages of the pneumatic ratchet wrench in accordance with the present invention are described as follows.

1. The elements assembled inside the body (10) are not many as the conventional pneumatic ratchet wrench, so that the volume of the pneumatic ratchet wrench can be reduced.

2. Also, because the eccentric spindle (14) and the gear assembly (142) are assembled together, the way to assemble the pneumatic ratchet wrench will be easy.

The invention may be varied in many ways by a person skilled in the art. Such variations are not to be regarded as a departure from the spirit and scope of the invention, and all such modifications are intended to be included within the scope of the following claims.

What is claimed is:

1. A pneumatic ratchet wrench comprising:

a) a body having:
- i) a front end;
- ii) a rear end;
- iii) a top;
- iv) a bottom;
- v) an outer surface;
- vi) a longitudinal cavity defined in the body;
- vii) external threads located on the outer surface near the front end,
- viii) a through hole defined in the body from the top to the bottom; and
- ix) a longitudinal through hole defined in the body and communicated with the through hole;

b) an air input valve mounted inside the rear end of the body and having:
- i) arearend;
- ii) a front end;
- iii) a joint defined at the rear end of the air input valve; and
- iv) an airway longitudinally defined through the air input valve and communicated with the through hole in the body;

c) a switch mounted in the through hole in the body and having:
- i) a button mounted inside the through hole in the body at the top;
- ii) a valve having an extended end extending out the bottom of the body; and
- iii) a spring having two ends, one end of the spring abutting the button and the other end of the spring abutting the valve;

d) a propeller mounted in the longitudinal cavity in the body and communicated with the longitudinal through hole in the body; and having:
- i) a spindle having a front end, a middle end, and an outer surface;
- ii) multiple vanes respectively mounted on the outer surface of the spindle at the middle end; and
- iii) a gear-like part defined on the outer surface of the spindle at the front end;

e) an eccentric spindle mounted on the front end of the propeller and having:
- i) a center;
- ii) a front end;
- iii) a rear end;
- iv) an outer surface;
- v) a lip formed on the outer surface of the eccentric spindle at the rear end;
- vi) a gear assembly having multiple gears respectively engaged on the gear-like part of the propeller at the rear end of the eccentric spindle; and
- vii) a rod extended out at the front end of the eccentric spindle away from the center, the rod and the lip are integrally made with the eccentric spindle;

f) a lever pivotally mounted on the bottom of the body and abutting the extended end of the valve;

g) a sleeve mounted inside the longitudinal cavity in the body and having:
- i) an inner surface; and
- ii) a teeth-like part defined in the inner surface of the sleeve and engaged with the gear assembly of the eccentric spindle;

h) a nut screwed at the threaded end of the body and having a threaded inner surface; and i) a head mounted on the nut and having:
- i) a U-shaped bracket having a front end, a rear end, an outer surface, two pieces, two mounting holes respectively defined in the two pieces of the U-shaped bracket, and an annular lip formed on the outer surface of the U-shaped bracket at the rear end, and
- ii) a ratchet head received inside the mounting holes in the U-shaped bracket and having a post mounted through the U-shaped bracket having a top, a bottom, a side surface, a set of teeth defined in the side surface of the post, a rod formed on the bottom of the post, and a lock washer mounted in the U-shaped bracket; and a fan-shaped action part mounted in the U-shaped bracket having afront end, a rearend, a central hole, a ratchet inner surface mounted inside the central hole of the fan-shaped action part and engaged with the set of teeth in the post adapted for allowing the tooth to move in only one direction, a recess defined in the rear end of the fan-shaped action part, and a connector received inside the recess and having a hole defined in the connector and the rod of the eccentric spindle mounted through the hole in the connector.

2. The pneumatic ratchet wrench as claimed in claim 1, wherein the pneumatic ratchet wrench further comprises a spindle sleeve partially mounted inside the sleeve and having:

a) a front end;

b) arearend;

c) a cavity;

d) an outer surface;

e) an inner surface;

f) a teeth-like inner surface defined in the inner surface of the spindle sleeve; and g) an annular lip formed on the outer surface of the spindle sleeve at the front end.

3. The pneumatic ratchet wrench as claimed in claim 2, wherein the gear assembly has three gears.

* * * * *